US005720318A

United States Patent [19]

Nagarajan et al.

[11] Patent Number: 5,720,318

[45] Date of Patent: Feb. 24, 1998

[54] SOLENOID ACTUATED MINISERVO SPOOL VALVE

[75] Inventors: Raj T. Nagarajan, Peoria; Charles R. Miller, Metamora, both of Ill.; Craig W. Lohmann, Denver, Iowa

[73] Assignee: Caterpillar Inc., Peoria, Ill.

[21] Appl. No.: 452,284

[22] Filed: May 26, 1995

[51] Int. Cl.[6] ..... E03B 1/00; F02M 39/00

[52] U.S. Cl. ..... 137/625.64; 239/88; 239/533.3

[58] Field of Search ..... 137/625.6, 625.64; 239/88, 89, 90, 91, 92, 533.1, 533.2, 533.3

[56] References Cited

U.S. PATENT DOCUMENTS

| | | | |
|---|---|---|---|
| 2,144,862 | 1/1939 | Truxell | 299/107.2 |
| 2,421,329 | 5/1947 | Hoffer | 210/166 |
| 2,434,586 | 1/1948 | Reynolds | 31/58 |
| 2,512,557 | 6/1950 | Weldy | 299/107.6 |
| 2,535,937 | 12/1950 | Bozec et al. | 299/107.6 |
| 2,552,445 | 5/1951 | Nielsen | 299/131 |

(List continued on next page.)

FOREIGN PATENT DOCUMENTS

| | | |
|---|---|---|
| 0 425 236 A1 | 5/1991 | European Pat. Off. . |
| 0246373 | 3/1992 | European Pat. Off. . |
| 58-183857 | 10/1983 | Japan . |
| 981664 | 12/1982 | U.S.S.R. . |

OTHER PUBLICATIONS

Frankl, et al., "Electronic Unit Injectors–Revised," *SAE Technical Paper Series,* 40th Annual Earthmoving Industry Conference, Peoria, Illinois, (Apr. 11–13, 1989).

Roters, "Electromagnetic Devices," First Edition, pp. 44–45, 67, 70, (No Date).

Sketch, "Fuel Injection Solenoid—Dual Latching," dated Sep. 3, 1992.

Caterpillar memorandum dated Aug. 30, 1994.

Sturman, "Breakthrough in Digital Valves," *Machine Design,* vol. 66, No. 4. dated Feb. 21, 1994, pp. 37–42.

U.S. Patent application No. 08/266,734 filed Jun. 27, 1994, entitled "Control Valve Assembly Adapted For a Fuel Injector".

U.S. Patent application No. 08/252,943 filed Jun. 2, 1994, entitled "Fuel Injection Control Valve".

U.S. Patent application No. 08/186,292 filed Jan. 25, 1994, entitled "Fuel Injection Control Valve".

*Primary Examiner*—Hoang Nguyen

*Attorney, Agent, or Firm*—Marshall, O'Toole, Gerstein, Murray & Borun; Joseph W. Keen

[57] ABSTRACT

A valve includes a housing having a high pressure inlet, a low pressure inlet, an outlet and first and second sealing surfaces. A pilot valve is disposed in the housing and includes a valve element movable between first and second positions. A movable spool is also disposed in the housing and includes third and fourth sealing surfaces engagable with the first and second sealing surfaces, respectively, carried by the housing to connect the outlet to the low pressure inlet when the valve element is in the first position and to connect the outlet to the high pressure inlet when the valve element is in the second position.

34 Claims, 8 Drawing Sheets

U.S. PATENT DOCUMENTS 2,597,952 5/1952 Rosenlund ..... 137/139
2,621,011 12/1952 Smith ..... 251/27
2,672,827 3/1954 McGowen, Jr. ..... 103/232
2,727,498 12/1955 Reiners ..... 123/32
2,749,181 6/1956 Maxwell et al. ..... 299/107.6
2,913,005 11/1959 Grant et al. ..... 137/625.6
2,916,048 12/1959 Gunkel ..... 137/544
3,035,780 5/1962 Peras ..... 239/453
3,057,560 10/1962 Campbell ..... 239/464
3,071,714 1/1963 Hadekel ..... 317/172
3,175,771 3/1965 Bréting ..... 239/533
3,410,519 11/1968 Evans ..... 251/141
3,532,121 10/1970 Sturman et al. ..... 137/625.4
3,570,806 3/1971 Sturman et al. ..... 251/65
3,570,807 3/1971 Sturman et al. ..... 251/65
3,570,833 3/1971 Sturman et al. ..... 267/161
3,585,547 6/1971 Sturman et al. ..... 335/227
3,604,959 9/1971 Sturman ..... 310/12
3,675,853 7/1972 Lapera ..... 239/464
3,683,239 8/1972 Sturman ..... 317/150
3,743,898 7/1973 Sturman ..... 317/154
3,753,547 8/1973 Topham ..... 251/120
3,814,376 6/1974 Reinicke ..... 251/129
3,821,967 7/1974 Sturman et al. ..... 137/624.15
3,835,829 9/1974 Links ..... 123/139 E
3,858,135 12/1974 Gray ..... 335/266
3,943,901 3/1976 Takahashi et al. ..... 123/139
3,952,711 4/1976 Kimberley et al. ..... 123/32
3,989,066 11/1976 Sturman et al. ..... 137/624.2
4,087,736 5/1978 Mori et al. ..... 322/28
4,087,773 5/1978 Jencks et al. ..... 335/243
4,107,546 8/1978 Sturman et al. ..... 307/141
4,108,419 8/1978 Sturman et al. ..... 251/30
4,114,647 9/1978 Sturman et al. ..... 137/624.2
4,114,648 9/1978 Nakajima et al. ..... 137/625.5
4,120,456 10/1978 Kimura et al. ..... 239/464
4,152,676 5/1979 Morgenthaler et al. ..... 333/24.1
4,189,816 2/1980 Chalansonnet ..... 29/148.4
4,192,466 3/1980 Tanasawa et al. ..... 239/464
4,231,525 11/1980 Palma ..... 239/585
4,248,270 2/1981 Ostrowski ..... 138/45
4,266,727 5/1981 Happel et al. ..... 239/409
4,273,291 6/1981 Müller ..... 239/533.12
4,275,693 6/1981 Leckie ..... 123/447
4,308,891 1/1982 Loup ..... 137/551
4,354,662 10/1982 Thompson ..... 251/129
4,375,274 3/1983 Thoma et al. ..... 239/117
4,392,612 7/1983 Deckard et al. ..... 239/88
4,396,037 8/1983 Wilcox ..... 137/625.65
4,409,638 10/1983 Sturman et al. ..... 361/152
4,482,094 11/1984 Knape ..... 239/88
4,501,290 2/1985 Sturman et al. ..... 137/495
4,516,600 5/1985 Sturman et al. ..... 137/495
4,518,147 5/1985 Andresen et al. ..... 251/121
4,526,519 7/1985 Mowbray et al. ..... 417/490
4,541,454 9/1985 Sturman et al. ..... 137/505
4,544,096 10/1985 Burnett ..... 239/92
4,558,844 12/1985 Donahue et al. ..... 251/118
4,610,428 9/1986 Fox ..... 251/129.16
4,653,455 3/1987 Eblen et al. ..... 123/506
4,658,824 4/1987 Scheibe ..... 123/472
4,702,212 10/1987 Best et al. ..... 123/472
4,721,253 1/1988 Noguchi et al. ..... 239/464
4,753,416 6/1988 Inagaki et al. ..... 251/129.15
4,794,890 1/1989 Richeson, Jr. ..... 123/90.11
4,811,221 3/1989 Sturman et al. ..... 364/420
4,812,884 3/1989 Mohler ..... 335/258
4,813,599 3/1989 Greiner et al. ..... 239/456
4,831,989 5/1989 Haines ..... 123/506
4,846,440 7/1989 Carlson et al. ..... 251/129.17
4,875,499 10/1989 Fox ..... 137/82
4,893,102 1/1990 Bauer ..... 335/132
4,893,652 1/1990 Nogle et al. ..... 137/596.17
4,928,887 5/1990 Miettaux ..... 239/584
4,964,571 10/1990 Taue et al. ..... 239/88
4,993,637 2/1991 Kanesaka ..... 239/96
5,004,577 4/1991 Ward ..... 264/112
5,042,445 8/1991 Peters et al. ..... 123/446
5,049,971 9/1991 Krumm ..... 357/55
5,050,543 9/1991 Kawamura ..... 123/90.11
5,051,631 9/1991 Anderson ..... 137/625.64 X
5,096,121 3/1992 Grinsteiner ..... 239/88
5,110,087 5/1992 Studtmann et al. ..... 251/129.16
5,121,730 6/1992 Ausman et al. ..... 123/467
5,131,624 7/1992 Kreuter et al. ..... 251/129.18
5,161,779 11/1992 Graner et al. ..... 251/129.16
5,188,336 2/1993 Graner et al. ..... 251/129.16
5,191,867 3/1993 Glassey ..... 123/446
5,339,777 8/1994 Cannon ..... 123/90.12
5,375,576 12/1994 Ausman et al. ..... 123/446
5,404,791 4/1995 Kervagoret ..... 137/625.64 X

SOLENOID ACTUATED MINISERVO SPOOL VALVE

TECHNICAL FIELD

The present invention relates generally to fluid valves, and more particularly to an actuable valve for operating a fluid control device, such as a fuel injector or an engine valve.

BACKGROUND ART

Actuation valves are often employed to operate fluid control devices, for example fuel injectors used in internal combustion engines. One type of actuation valve includes a solenoid and a double-acting poppet valve which controls the admittance of pressurized fluid, e.g., engine oil, into an intensifier chamber. The pressurized fluid acts against the intensifier piston so that the piston is displaced in a direction which causes fuel located in a high pressure chamber to be pressurized. The pressurized fuel in turn acts against a spring-biased check and, when the pressure of the fuel rises to a high enough level, the check is opened and the fuel is injected into an associated combustion chamber.

While such actuation valves have generally been found to operate satisfactorily in most applications, there are some engine applications where the injector must be operated at speeds which cannot be accommodated by a poppet-type valve. Poppet-type valves also pose manufacturing challenges.

DISCLOSURE OF THE INVENTION

A valve according to the present invention is capable of fast operation and is desirably small and light in weight as compared with prior valves.

More particularly, in accordance with one aspect of the present invention, a valve includes a housing having a high pressure inlet, a low pressure inlet, an outlet and first and second sealing surfaces and further includes a pilot valve disposed in the housing and including a valve element movable between first and second positions. A movable spool is disposed in the housing and includes third and fourth sealing surfaces engagable with the first and second sealing surfaces, respectively, carried by the housing to connect the outlet to the low pressure inlet when the valve element is in the first position and to connect the outlet to the high pressure inlet when the valve element is in the second position.

Preferably, an actuator, such as a solenoid, is actuable to move the valve element between the first and second positions. Also, the actuator may be secured to the housing.

The valve element and the spool are preferably movable along parallel paths, and more particularly, a longitudinal central axis of the spool may be substantially coincident with a path of movement of a center point of the valve element.

In accordance with a specific aspect of the present invention, the first sealing surface is preferably in fluid communication with the high pressure inlet and the second sealing surface is in fluid communication with the low pressure inlet. Also, a spring may be provided to bias the spool toward a particular position. Still further, the valve may be used in combination with a high pressure fluid source coupled to the high pressure inlet and a low pressure fluid source coupled to the low pressure inlet.

The pilot valve may include a low pressure port, a high pressure port and an outlet port coupled to the high pressure port or to the low pressure port when the valve element is in the first or second positions, respectively. The pilot valve may further include a first passage between the high pressure inlet and the high pressure port of the pilot valve and a second passage between the low pressure port of the pilot valve and a drain outlet. A first end of the spool may be placed in fluid communication with the high pressure inlet and a second end of the spool may be placed in fluid communication with the outlet port of the pilot valve.

In addition to the foregoing, the valve element preferably comprises a ball movable between first and second seats.

In accordance with a further aspect of the present invention, a fuel injector actuation valve includes an actuator and a body coupled to the actuator having a high pressure inlet, a low pressure inlet, an outlet adaptable for connection to a fuel injector intensifier and first and second sealing surfaces. A pilot valve is disposed in the body and includes a high pressure port, a low pressure port, an outlet port and a ball element movable by the actuator between a first position wherein the high pressure port is in fluid communication with the outlet port and a second position wherein the low pressure port is in fluid communication with the outlet port. A movable spool is disposed in the housing and includes third and fourth sealing surfaces engagable with the first and second sealing surfaces, respectively, of the body, a first end in fluid communication with the high pressure inlet and a second end in fluid communication with the outlet port of the pilot valve.

In accordance with yet another aspect of the present invention, a fuel injector actuation valve includes an actuator and a body coupled to the actuator having a high pressure inlet, a low pressure inlet, an outlet adaptable for connection to a fuel injector intensifier and first and second sealing surfaces in fluid communication with the high pressure inlet and the low pressure inlet, respectively. A high pressure fluid source is coupled to the high pressure inlet and a low pressure fluid source is coupled to the low pressure inlet. A pilot valve is disposed in the body and includes a high pressure port in fluid communication with the high pressure fluid source, a low pressure port in fluid communication with the drain, an outlet port and a ball element movable by the actuator between a first ball element position wherein the high pressure port is in fluid communication with the outlet port and a second ball element position wherein the low pressure port is in fluid communication with the outlet port. A spool is disposed in the body and includes third and fourth sealing surfaces, a first end in fluid communication with the high pressure fluid source and a second end in fluid communication with the outlet port of the pilot valve. The spool is movable between a first spool position wherein the third sealing surface of the spool is engaged with the first sealing surface of the body and a second spool position wherein the fourth sealing surface of the spool is engaged with the second sealing surface of the sleeve. Means are also provided for biasing the spool toward the first spool position.

The force of the actuator utilized in the present invention acts against a low mass valve element and does not act directly against a spring force. Because of these factors, the actuator can be made desirably small and light in weight.

BEST MODE FOR CARRYING OUT THE INVENTION

Figure 1:
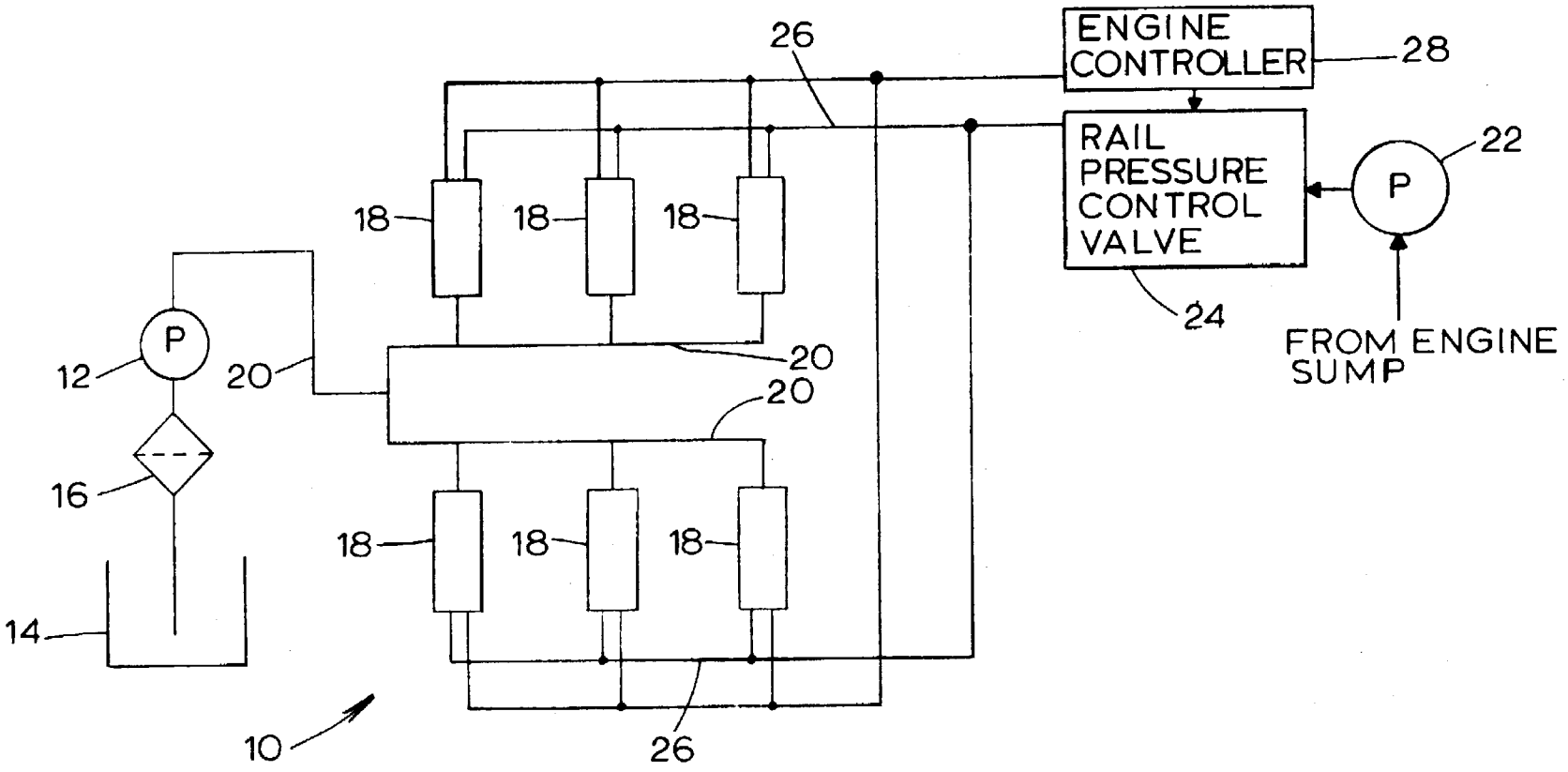
FIG. 1 comprises a combined schematic and block diagram of a fuel injection system.

Referring now to FIG. 1, a hydraulically-actuated, electronically-controlled unit injector (HEUI) system 10 includes a transfer pump 12 which receives fuel from a fuel tank 14 and a filter 16 and delivers same at a relatively low pressure of, for example, about 0.414 MPa (60 p.s.i.), to fuel injectors 18 via fuel rail lines or conduits 20. An actuating fluid, such as engine oil supplied from an engine sump, is pressurized by a pump 22 to a nominal intermediate pressure of, for example, 20.7 MPa (3,000 p.s.i.). A rail pressure control valve 24 may be provided to modulate the oil pressure provided over oil rail lines or conduits 26 to the injectors 18 in dependence upon the level of a signal supplied by an electronic engine controller 28. In response to electrical control signals developed by the engine controller 28, the fuel injectors 18 inject fuel at a high pressure of, for example, 138 MPa (20,000 p.s.i.) or greater, into associated combustion chambers or cylinders (not shown) of an internal combustion engine. While six fuel injectors 18 are shown in FIG. 1, it should be noted that a different number of fuel injectors may alternatively be used to inject fuel into a like number of associated combustion chambers. Also, the engine with which the fuel injection system 10 may be used may comprise a diesel-cycle engine, an ignition assisted engine or any other type of engine where it is necessary or desirable to inject fuel therein.

If desired, the fuel injection system 10 of FIG. 1 may be modified by the addition of separate fuel and/or oil supply lines extending between the pumps 12 and 22 and each injector 18. Alternatively, or in addition, fuel or any other fluid may be used as the actuating fluid and/or the timing and injection duration of the injectors may be controlled by mechanical or hydraulic apparatus rather than the engine controller 28, if desired.

Figure 2A:
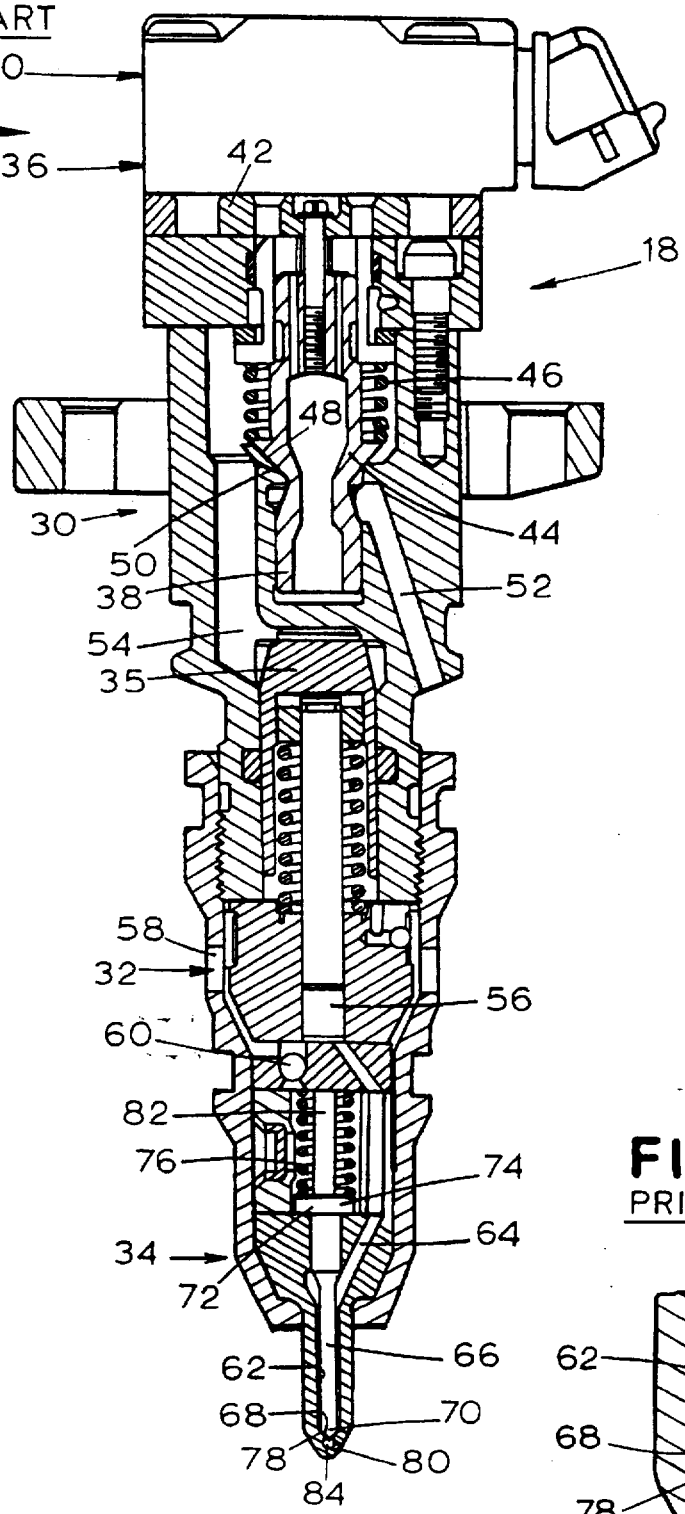
FIG. 2A PRIOR ART
FIG. 2A comprises an elevational view, partly in section, of a prior art fuel injector.
Figure 2B:
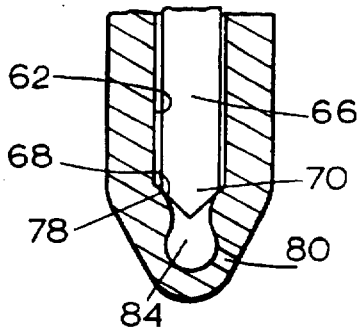
FIG. 2B PRIOR ART
FIG. 2B comprises an enlarged, fragmentary sectional view of the tip of the injector shown in FIG. 2A.
Figure 3:
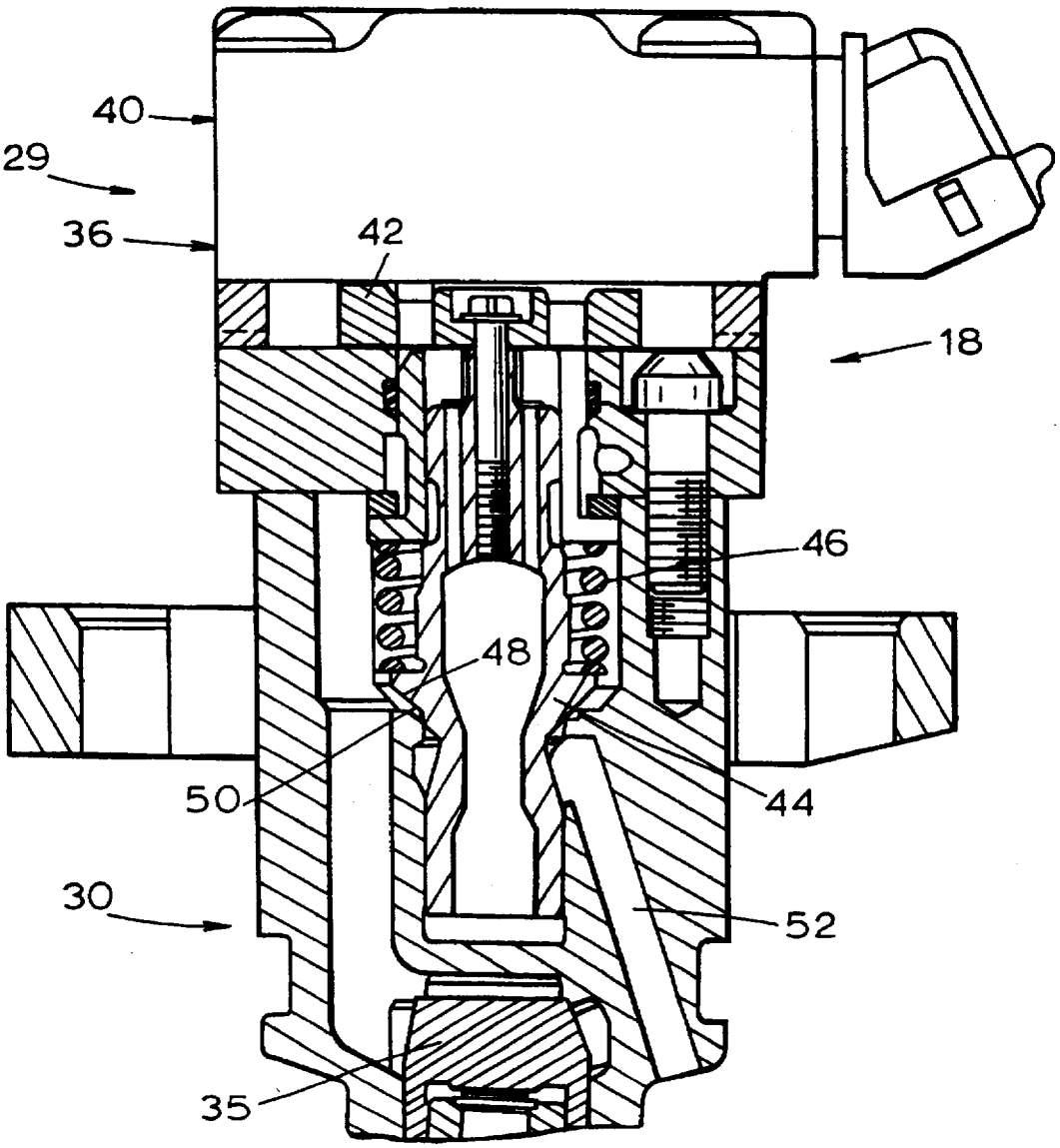
FIG. 3 PRIOR ART
FIG. 3 comprises an enlarged, fragmentary sectional view of the fuel injector of FIG. 2.

FIGS. 2A, 2B and 3 illustrate a prior art fuel injector 18 which is usable with the fuel injection system 10 of FIG. 1. The fuel injector is disclosed in Glassey U.S. Pat. No. 5,191,867 and reference should be had thereto for a full description of the injector. The fuel injector 18 includes an actuator and valve assembly 28, a body assembly 30, a barrel assembly 32 and a nozzle and tip assembly 34. The actuator and valve assembly 28 acts as a means for selectively communicating either relatively high pressure oil or low pressure oil to an intensifier piston 35. The actuator and valve assembly 28 includes an actuator 36, preferably in the form of a solenoid assembly, and a valve 38, preferably in the form of a poppet valve. The solenoid assembly 36 includes a fixed stator assembly 40 and a movable armature 42 coupled to a poppet 34 of the valve 38.

When the actuator 36 is deenergized, a spring 46 biases the poppet 44 so that a sealing surface 48 of the poppet 44 is disposed in sealing contact with a valve seat 50. Consequently, an oil inlet passage 52 is taken out of fluid communication with an intensifier chamber 54. When fuel injection is to commence the actuator 36 is energized by an electrical control signal developed by the engine controller 28, causing the poppet 44 to be displaced upwardly and spacing the sealing surface 48 from the valve seat 50. Pressurized oil then flows from the oil inlet passage 52 into the intensifier chamber 54. In response to the admittance of pressurized fluid into the chamber 35, the intensifier piston 45 is displaced downwardly, thereby pressurizing fuel drawn into a high pressure chamber 56 through a fuel inlet 58 and a check valve 60. The pressurized fuel is supplied to a check bore 62 through passages 64. An elongate check 66 is disposed in the check bore 62 and, as seen most clearly in FIG. 2B, includes a sealing tip 68 disposed at a first end portion 70 and an enlarged plate or head 72 disposed at a second end portion 74. A spring 76 biases the tip 68 against a valve seat 78 to isolate the check bore 62 from one or more nozzle orifices 80.

Figure 4:
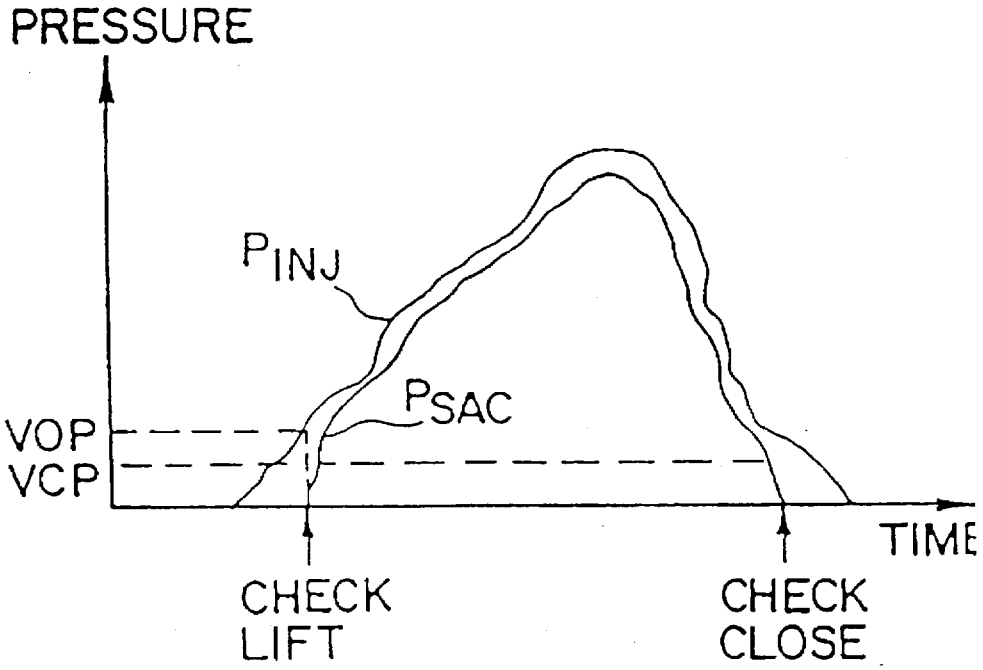
Fig. 4 PRIOR ART
FIG. 4 comprises a graph illustrating the operation of the fuel injector of FIGS. 2 and 3.

Referring also to FIG. 4, when the pressure $P_{INJ}$ within the check bore 62 reaches a selected valve opening pressure (VOP), check lift occurs, thereby spacing the tip 68 from the valve seat 78 and permitting pressurized fuel to escape through the nozzle orifice 80 into the associated combustion chamber. The pressure VOP is defined as follows:

$$VOP = \frac{S}{A1 - A2}$$

where S is the load exerted by the spring 76, A1 is the cross-sectional dimension of a valve guide 82 of the check 66 and A2 is the diameter of the line defined by the contact of the tip 68 with the valve seat 78.

At and following the moment of check lift, the pressure $P_{SAC}$ in an injector tip chamber 84 increases and then decreases in accordance with the pressure $P_{INJ}$ in the check bore 62 until a selected valve closing pressure (VCP) is reached, at which point the check returns to the closed position. The pressure VCP is determined in accordance with the following equation:

$$VCP = \frac{S}{A1}$$

where S is the spring load exerted by the spring 76 and A1 is the cross-sectional diameter of the guide portion 82, as noted previously.

As the foregoing discussion demonstrates, the force developed by the actuator 36 must overcome the bias force of the spring 46 and the inertia of the poppet 44. Thus, the actuator 36 must develop a relatively high actuating force and must be capable of rapidly moving a relatively high mass poppet in order to obtain proper operation. This results in the need to utilize an actuator 36 which is relatively large and robust.

Figure 5:
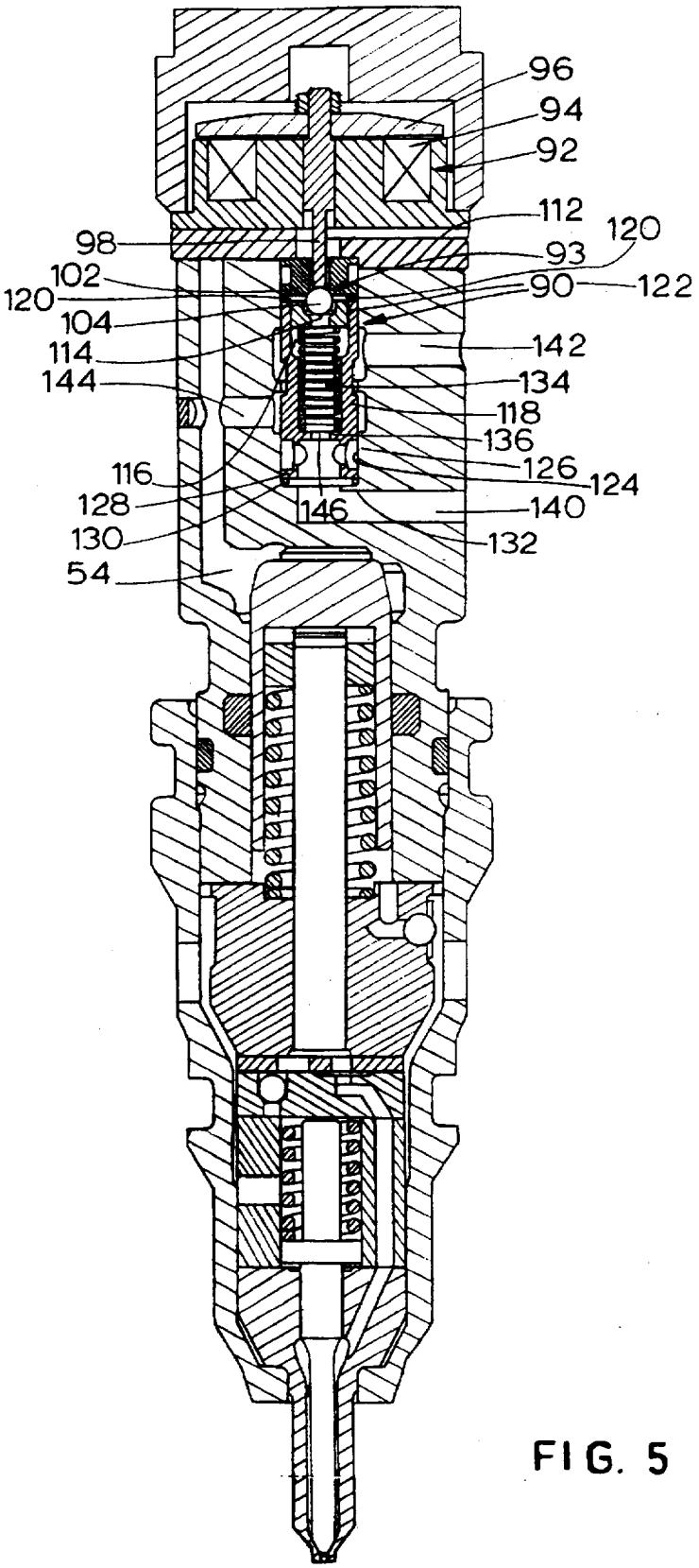
FIG. 5 is a view similar to FIG. 2 of a fuel injector incorporating the valve of the present invention in a first valve position.
Figure 6:
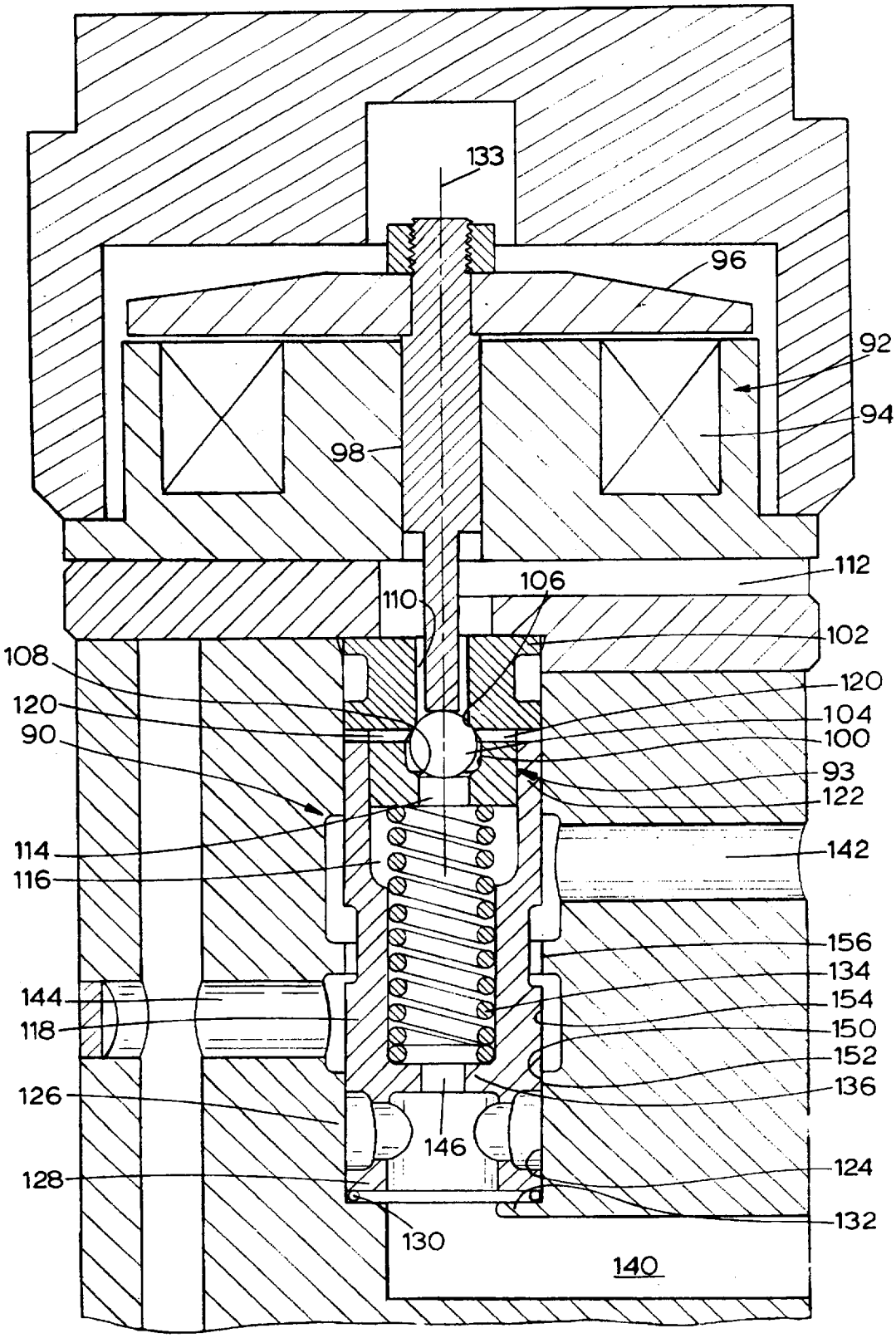
FIG. 6 is an enlarged fragmentary sectional view illustrating the valve of FIG. 5 in greater detail.
Figure 7:
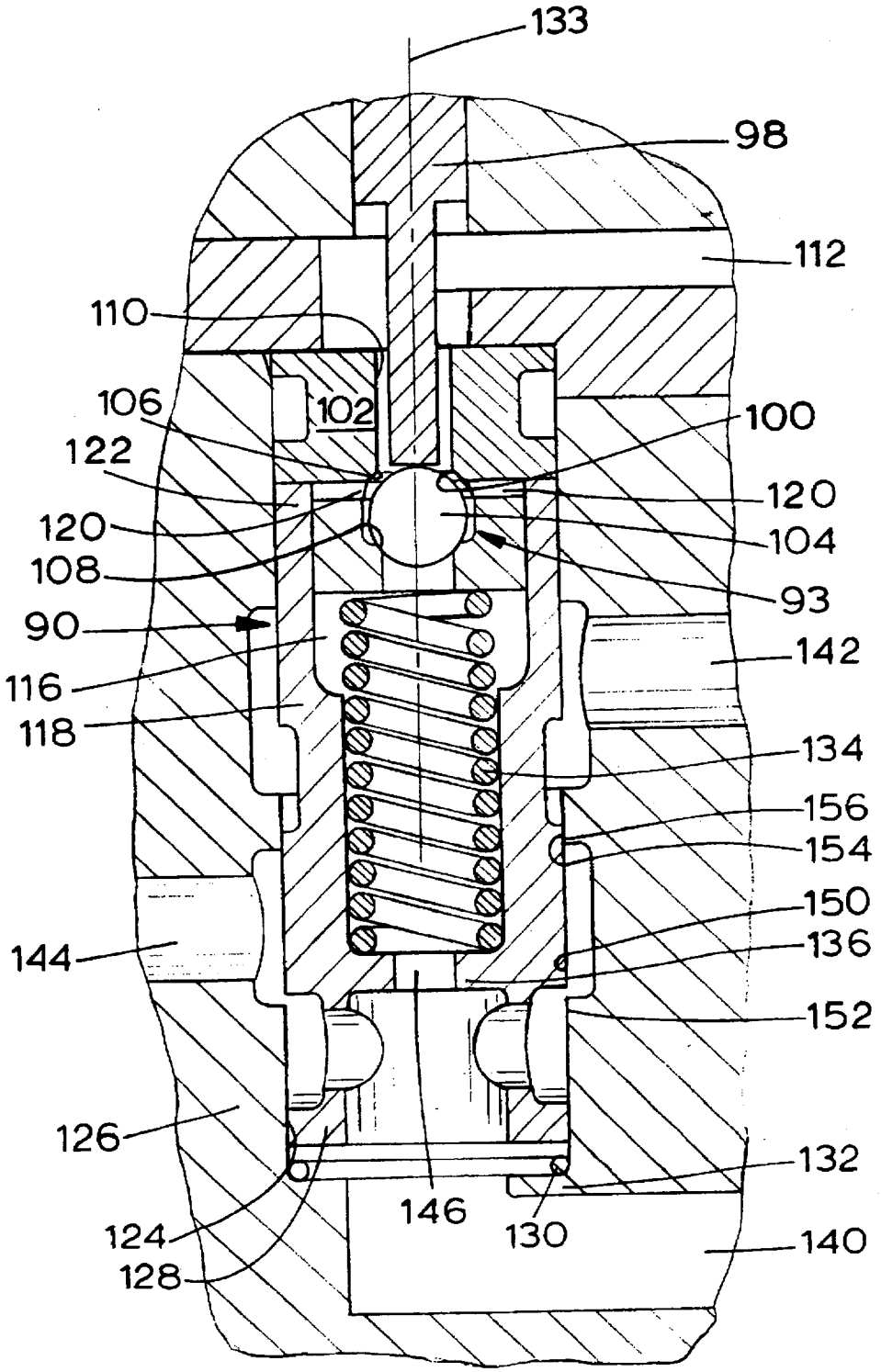
FIG. 7 is an enlarged fragmentary sectional view similar to FIG. 6 illustrating the valve of the present invention in a second valve position.

FIGS. 5–7 illustrate an actuator and valve assembly 90 which may be used in place of the actuator and valve assembly 28 in the fuel injector illustrated in FIGS. 2A, 2B and 3. The assembly 90 includes an actuator 92 and a pilot valve 93. The actuator 92 may comprise a solenoid having a solenoid winding 94, an armature 96 and a plunger 98 coupled to the armature 96 and movable therewith. The plunger 98 extends into a valve element chamber 100 formed by a valve body member 102 of the pilot valve 93. A valve element in the form of a ball element 104 is disposed within the valve element chamber 100 and is movable between a first or upper position, seen in FIGS. 5 and 6, wherein the ball element 102 is disposed in sealing contact with a first or upper sealing surface or seat 106, and a second position, seen in FIG. 7, wherein the ball element 104 is disposed in sealing contact with a second or lower sealing surface or seat 108. The valve body member 102 includes a passage 110 defining a low pressure port which is disposed in fluid communication with a drain passage 112 located in the actuator 102 and which is coupled to engine sump. A further passage 114 defines a high pressure port which interconnects the valve element chamber 100 with a chamber 116 within a movable spool 118. Each of one or more cross passages 120 defines an outlet port and interconnects the valve element chamber 100 with an end 122 of the spool 118.

The spool 118 is disposed in sliding relationship within a bore 124 formed within a housing or body 126. The spool 118 is movable between a lower position, seen in FIGS. 5 and 6, in which a second end 128 of the spool 118 is disposed in contact with a shouldered portion 132 of the body 126, and an upper position, seen in FIG. 7, wherein the upper end 122 of the spool 118 is in contact with the valve body member 102.

Preferably, although not necessarily, the ball element 104 and the spool 118 are movable along parallel paths and, in the preferred embodiment, a longitudinal central axis 133 of the spool 118 (FIG. 6) is substantially coincident with a path of movement of the ball element 104.

A spring 134 is placed in compression between the valve body member 102 and a shouldered portion 136 of the spool 118 and biases the spool 118 to the lower position.

The body 126 includes a high pressure inlet 140 which receives pressurized oil from the rail pressure control valve 24 of FIG. 1, a low pressure inlet 142 which may be coupled to any low pressure oil source, such as engine sump, and an outlet 144 which is coupled to the intensifier chamber 54. If desired, the actuator 92 may be secured to the body 126 by any suitable means, such as screws or any other fasteners.

Industrial Applicability

When the actuator 92 is deenergized, the ball element 104 is in the position illustrated in FIGS. 5 and 6 owing to the fluid pressure imbalance created by high pressure oil in the chamber 116 as introduced therein through the inlet 140 and a bore 146 in the spool 118 and the low fluid pressure present in the passage 110. Because the ball element 104 is in sealing engagement with the upper sealing surface 106 and is spaced from the lower sealing surface 108, the upper end 122 of the spool 118 is placed in fluid communication with the high pressure oil in the chamber 116. As a result, the fluid pressures on the ends 122, 128 of the spool 118 are equalized and the only force acting on the spool 118 is the bias exerted by the spring 134. Consequently, the spool 118 is moved to the lower position shown in FIGS. 5 and 6, thereby causing a sealing surface 150 of the spool 118 to be in sealing contact with a sealing surface 152 of the body 126. Further, a sealing surface 154 of the spool 118 is spaced from a sealing surface 156 of the body 126. Under these conditions, high pressure oil from the inlet 140 is blocked from the outlet 144 and the outlet 144 is placed in fluid communication with the low pressure inlet 142.

As seen in FIG. 7, when the actuator 92 is energized, the armature 96 and the plunger 98 move downwardly, thereby causing the ball element 104 to be spaced away from the upper sealing surface 106 and to move into engagement with the lower sealing surface 108. The upper end 122 of the spool 118 is then isolated from the high pressure oil in the chamber 116 and is placed in fluid communication with the drain passage 112. Because of the unequal fluid pressures acting on the ends 122, 128 of the spool 118, a differential force is developed on the spool 118 to cause it to move to the upper position seen in FIG. 7. In this position, the sealing surface 154 is in sealing contact with the sealing surface 156 to isolate the outlet 144 from the low pressure inlet 142. Moreover, the sealing surface 150 moves out of contact with the sealing surface 152 to place the outlet 144 in fluid communication with the inlet 140. Pressurized oil is then able to flow into the intensifier chamber 54 to drive the intensifier piston 35 downwardly.

As should be evident from the foregoing, the actuator force acts directly on a ball element, rather than on a spool or a poppet. As a result, a low force actuator can be used, for example one which develops a force as low as 50 newtons. Such an actuator could be relatively easily manufactured at low cost and can utilize low voltage driver signals from the engine controller 28. Further, flow forces on the ball are significantly reduced as compared with other valves. Also, the actuator force need not overcome a spring preload. Consequently, faster response can be achieved. Still further, valve performance can be optimized by varying different parameters, such as the biasing force exerted by the spring 134, the size, lift and ball seat flow areas, and the like.

If desired, another type of pilot valve other than the ball-type valve shown in the FIGS. could alternatively be used.

Figure 8:
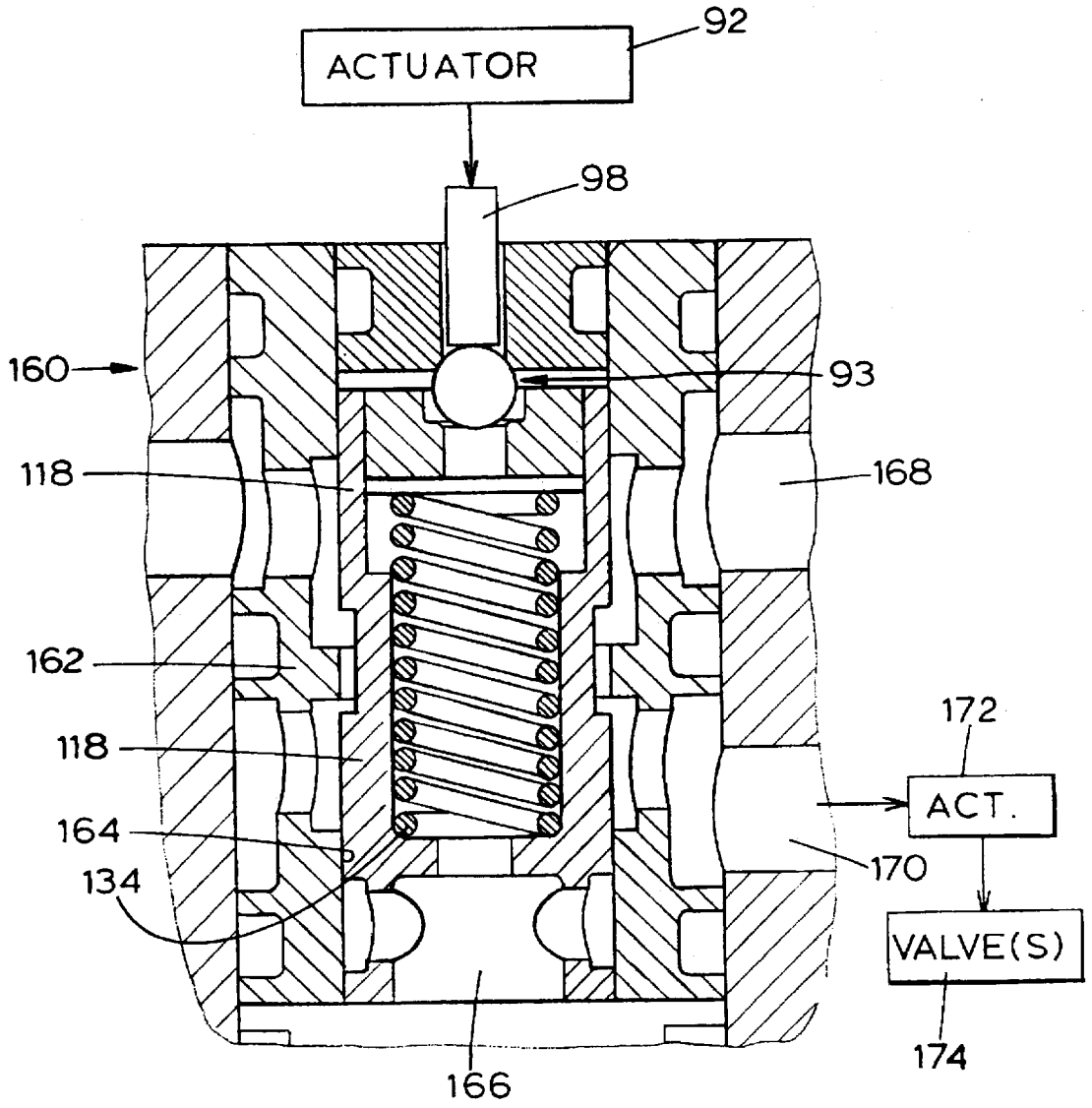
FIG. 8 is a sectional view of a valve according to the present invention adapted to actuate an engine valve.

Still further, it should be noted that this valve could be adapted for use with other types of loads, for example, an engine valve. For example, FIG. 8 illustrates a valve 160 according to the present invention wherein elements common to FIG. 8 and the remaining FIGS. are assigned like reference numerals. The valve 160 includes the plunger 98 coupled to the actuator 92, the pilot valve 93 in the form of a ball valve and the spool 118. In this embodiment, the spool 118 is disposed for sliding movement between first and second positions within a housing in the form of a sleeve 162. The sleeve 162 includes inner surfaces 164 which are identical to the inner surfaces of the body 126. The sleeve 162 further includes high and low pressure inlets 166, 168, which are identical to the high and low pressure inlets 140, 142, respectively, described above. An outlet 170, identical to the outlet 144 of FIGS. 5–7, is in fluid communication with a fluid-driven actuator 172 which in turn contacts one or more intake or exhaust valves 174 of an engine.

As with the previously described embodiment, when high pressure fluid is to be delivered to the actuator 172 to open the intake or exhaust valves 174, the actuator 92 is energized, thereby causing the pilot valve 93 to balance the fluid pressures across the spool 118 so that the spring 134 moves the spool 118 to a position which causes high pressure fluid at the high pressure inlet 166 to flow through the outlet 170 to the actuator 172. When the intake or exhaust valves 174 are to be closed, the actuator 92 is deenergized, thereby causing the pilot valve 93 to develop a pressure differential across the spool 118 so that the spool is moved to a position which places the low pressure inlet 168 in fluid communication with the outlet 170. The low pressure fluid is delivered to the actuator 172 so that the intake or exhaust valves 174 may be closed by springs (not shown) acting thereagainst.

Because the pilot valve and the spool valve are coaxially disposed relative to one another, the valve is easy to manufacture, assemble and install and is low in cost. Also, the flow lines for delivering fluid to the valve components are kept desirably short.

Also, it should be noted that the actuator may be of a different type, such as a solid-state motor comprising piezoelectric elements and an amplifier.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. A valve, comprising: a housing including a high pressure inlet, a low pressure inlet, an outlet and first and second sealing surfaces; a pilot valve disposed in the housing and including a valve element movable between first and second positions; and a movable spool disposed in the housing and including third and fourth sealing surfaces engagable with the first and second sealing surfaces, respectively, carried by the housing to connect the outlet to the low pressure inlet when the valve element is in the first position and to connect the outlet to the high pressure inlet when the valve element is in the second position said spool having first and second ends wherein said first end is in fluid communication with said high pressure inlet regardless of said pilot valve's position.

2. The valve of claim 1, further including an actuator actuable to move the valve element between the first and second positions.

3. The valve of claim 2, wherein the actuator is secured to the housing.

4. The valve of claim 1, wherein the valve element and the spool are movable along parallel paths.

5. The valve of claim 1, wherein the spool includes a longitudinal central axis substantially coincident with a path of movement of a center point of the valve element as the valve element moves between the first and second positions.

6. The valve of claim 1, wherein the first sealing surface is in fluid communication with the high pressure inlet and the second sealing surface is in fluid communication with the low pressure inlet.

7. The valve of claim 1, further including a spring which biases the spool toward a particular position.

8. The valve of claim 1, in combination with a high pressure fluid source coupled to the high pressure inlet and a low pressure fluid source coupled to the low pressure inlet.

9. The valve of claim 8, wherein the pilot valve includes a low pressure port, a high pressure port and an outlet port coupled to the high pressure port or to the low pressure port when the valve element is in the first or second positions, respectively, and wherein the valve further includes a first passage between the high pressure inlet and the high pressure port of the pilot valve and a second passage between the low pressure port of the pilot valve and a drain outlet and wherein said second end of the spool is in fluid communication with the outlet port of the pilot valve.

10. The valve of claim 1, wherein the valve element comprises a ball movable between first and second seats.

11. The valve of claim 1, wherein the actuator comprises a solenoid.

12. A valve adapted to actuate a fuel injector, comprising:

an actuator;

a body having a high pressure inlet, a low pressure inlet, an outlet adapted for connection to a fuel injector intensifier and first and second sealing surfaces;

a pilot valve disposed in the body and including a high pressure port, a low pressure port, an outlet port and a ball element movable by the actuator between a first position wherein the high pressure port is in fluid communication with the outlet port and a second position wherein the low pressure port is in fluid communication with the outlet port; and a movable spool disposed in the body and having third and fourth sealing surfaces engagable with the first and second sealing surfaces, respectively, of the body, a first end in fluid communication with the high pressure inlet and a second end in fluid communication with the outlet port of the pilot valve.

13. The valve of claim 12, wherein the actuator is secured to the body.

14. The valve of claim 12, wherein the ball element and the spool are movable along parallel paths.

15. The valve of claim 12, wherein the spool includes a longitudinal central axis substantially coincident with a path of movement of a center point of the ball element as the ball element moves between the first and second positions.

16. The valve of claim 12, wherein the first sealing surface is in fluid communication with the high pressure inlet and the second sealing surface is in fluid communication with the low pressure inlet.

17. The valve of claim 16, further including a spring which biases the spool toward a particular position at which the low pressure inlet is placed in fluid communication with the outlet of the body.

18. The valve of claim 17, in combination with a high pressure fluid source coupled to the high pressure inlet and a low pressure fluid source coupled to the low pressure inlet.

19. The valve of claim 18, wherein the pilot valve includes a low pressure port, a high pressure port and an outlet port coupled to the high pressure port or to the low pressure port when the valve element is in the first or second positions, respectively, and further including a first passage between the high pressure inlet and the high pressure port of the pilot valve and a second passage between the low pressure port of the pilot valve and a drain outlet.

20. The valve of claim 12, in combination with a fuel injector coupled to the outlet of the body.

21. The valve of claim 20, wherein the fuel injector is of the hydraulically-actuated, electronically-controlled type.

22. A fuel injector actuation valve, comprising:

an actuator;

a body coupled to the actuator having a high pressure inlet, a low pressure inlet, an outlet adaptable for connection to a fuel injector intensifier and first and second sealing surfaces in fluid communication with the high pressure inlet and the low pressure inlet, respectively;

a high pressure fluid source coupled to the high pressure inlet;

a low pressure fluid source coupled to the low pressure inlet;

a pilot valve disposed in the body and including a high pressure port in fluid communication with the high pressure fluid source, a low pressure port in fluid communication with a drain, an outlet port and a ball element movable by the actuator between a first ball element position wherein the high pressure port is in fluid communication with the outlet port and a second ball element position wherein the low pressure port is in fluid communication with the outlet port;

a spool disposed in the body and having third and fourth sealing surfaces, a first end in fluid communication with the high pressure fluid source and a second end in fluid communication with the outlet port of the pilot valve, the spool being movable between a first spool position wherein the third sealing surface is engaged with the first sealing surface of the body and a second spool position wherein the fourth sealing surface is engaged with the second sealing surface of the body; and means for biasing the spool toward the first spool position.

23. The fuel injector actuation valve of claim 22, wherein the actuator comprises a solenoid having a plunger in contact with the ball element.

24. The fuel injector actuation valve of claim 23, wherein the ball element moves in a path coaxial with a path of movement of the spool.

25. The fuel injector actuation valve of claim 22, wherein the spool is moved by a fluid pressure imbalance from the first spool position to the second spool position.

26. The fuel injector actuation valve of claim 22, in combination with a fuel injector coupled to the outlet of the body.

27. The fuel injector actuation valve of claim 26, wherein the fuel injector is of the hydraulically-actuated, electronically-controlled type.

28. The valve of claim 2 wherein said actuator selectively provides an actuation force of less than 100 Newtons.

29. The valve of claim 12 wherein said actuator selectively provides an actuation force of less than 100 Newtons.

30. The fuel injection actuation valve of claim 22 wherein said actuator selectively provides an actuation force of less than 100 Newtons.

31. The valve of claim 1 wherein said valve element is moveable from said second to said first position by fluid pressure alone.

32. The valve of claim 12 wherein said ball element is moveable from said second to said first position by fluid pressure alone.

33. The valve of claim 22 wherein ball element is moveable from said second ball element position to said first ball element position by fluid pressure alone.

34. A valve, comprising:

a housing including a high pressure inlet, a low pressure inlet, an outlet and first and second sealing surfaces;

a pilot valve disposed in the housing and including a valve element movable between first and second positions wherein said valve element is movable from said second position to said first position by fluid pressure alone from said high pressure inlet; and a movable spool disposed in the housing and including third and fourth sealing surfaces engagable with the first and second sealing surfaces, respectively, carried by the housing to connect the outlet to the low pressure inlet when the valve element is in the first position and to connect the outlet to the high pressure inlet when the valve element is in the second position.

* * * * *